US008405562B2

(12) United States Patent
Rice

(10) Patent No.: US 8,405,562 B2
(45) Date of Patent: Mar. 26, 2013

(54) PHOTOCONDUCTIVE SEMICONDUCTOR FIBER ANTENNA

(75) Inventor: Robert Rex Rice, Simi Valley, CA (US)

(73) Assignee: Northrop Grumman Systems Corporation, Falls Church, VA (US)

( * ) Notice: Subject to any disclaimer, the term of this patent is extended or adjusted under 35 U.S.C. 154(b) by 495 days.

(21) Appl. No.: 12/720,107

(22) Filed: Mar. 9, 2010

(65) Prior Publication Data

US 2011/0221641 A1 Sep. 15, 2011

(51) Int. Cl.
*H01Q 1/06* (2006.01)

(52) U.S. Cl. ..... 343/721; 343/833; 343/702

(58) Field of Classification Search ..... 343/702, 343/833, 821

See application file for complete search history.

(56) References Cited

U.S. PATENT DOCUMENTS

| | | | | |
|---|---|---|---|---|
| 5,560,776 | A | 10/1996 | Sugai et al. | |
| 5,886,670 | A | 3/1999 | Manasson et al. | |
| 6,046,705 | A | 4/2000 | Anderson | |
| 6,087,993 | A | 7/2000 | Anderson et al. | |
| 6,177,909 | B1 | 1/2001 | Reid et al. | |
| 6,476,596 | B1 * | 11/2002 | Wraback et al. | 250/338.4 |
| 6,621,459 | B2 | 9/2003 | Webb et al. | |
| 6,657,594 | B2 | 12/2003 | Anderson | |
| 6,825,814 | B2 | 11/2004 | Hayes | |
| 6,879,289 | B2 | 4/2005 | Hayes | |
| 6,922,173 | B2 | 7/2005 | Anderson | |
| 7,023,393 | B2 | 4/2006 | Ishii et al. | |
| 7,061,447 | B1 | 6/2006 | Bozler et al. | |
| 7,307,258 | B2 | 12/2007 | Tao et al. | |
| 7,342,549 | B2 | 3/2008 | Anderson | |
| 7,456,791 | B2 | 11/2008 | Pellet | |
| 7,474,273 | B1 | 1/2009 | Pavliscak et al. | |
| 2004/0257292 | A1 * | 12/2004 | Wang | 343/833 |
| 2005/0242287 | A1 * | 11/2005 | Hakimi | 250/363.09 |
| 2009/0073053 | A1 | 3/2009 | Nevo et al. | |

OTHER PUBLICATIONS

D. S. Deng, N. D. Orf, S. Danto, A. F. Abouraddy, J. D. Joannopoulos, and Y. Fink, "Processing and properties of centimeter-long, in-fiber, crystalline-selenium filaments", Appl. Phys. Lett. 96, 023102 (2010).

Wei Shi, Hong Xue, Xiangrong Ma, and Zhenzhen Zhang, "Intense Terahertz Radiation from GaAs Photoconductive Antenna Array", PIERS Proceedings, Mar. 23-27, 2009, pp. 1698-1701, Beijing, China.

Masayoshi Tonouchi, "Cutting-edge terahertz technology", Nature Photonics, Feb. 2007, pp. 97-105, vol. 1, Nature Publishing Group.

* cited by examiner

*Primary Examiner* — Dieu H Duong

(74) *Attorney, Agent, or Firm* — John A. Miller; Miller IP Group, PLC

(57) ABSTRACT

An antenna system including at least one fiber antenna element having a semiconductor core and an outer cladding layer, where the core has a higher index of refraction than the cladding layer. A pump source provides pump light to the cladding layer in a manner that allows the pump light to propagate down the cladding layer to be absorbed by the core to generate photo-carriers in the core. An antenna circuit is electrically coupled to the core and provides one or both of an RF signal to the core for transmission purposes or receiving an RF signal from the core for reception purposes.

20 Claims, 2 Drawing Sheets

PHOTOCONDUCTIVE SEMICONDUCTOR FIBER ANTENNA

BACKGROUND

1. Field of the Disclosure

This disclosure relates generally to a photoconductive semiconductor fiber antenna and, more particularly, to a photoconductive semiconductor fiber antenna that includes a semiconductor core and an outer cladding layer, where the cladding layer receives an optical pump beam that propagates down the cladding layer to be absorbed by the core and generate photo-carriers.

2. Discussion of the Related Art

There are situations and conditions where it is desirable to transmit and receive RF signals from a physical location without employing an antenna that can be detected at the location. Antennas are typically fabricated from electrically conducting wires or other components, and as such, will reflect incident electromagnetic waves, such as those from search radar beams. The magnitude of the radar reflectivity of a structure is referred to as its radar cross-section (RCS), and a considerable effort has been devoted to the reduction and control of a structure's RCS for various military platforms. For these situations in general, it would be desirable to transmit and receive electro-magnetic (EM) waves from a non-conductive antenna device. Unfortunately, the transmission of EM waves requires an oscillating current flow in a conductor. A next best approach is to provide an antenna structure that can be effectively turned on and off. That is the goal for the extensive research into plasma antennas, well known to those skilled in the art.

A conventional plasma antenna is essentially a structure that includes an electrical or RF discharge in a gas provided within a dielectric tube that renders the gaseous column in the tube electrically conductive by the presence of free electrons and ions. As an electrical conductor, the dielectric tube can also support RF currents impressed thereon by a transmitter or as a result of an incident received signal. Potential commercial applications for plasma antennas include a reconfigurable plasma antenna or a beam scanned array for communications systems. Although a plasma antenna provides a conductive structure that can be detected by search beams, the plasma antenna has the ability to be switched off when not in use, where it is non-conductive and thus undetectable. However, plasma antennas typically have a significant RF emission when they are active that provides a background noise that limits the sensitivity of the antenna for receiving low intensity signals. Also, plasma antennas require a heavy power source for operation.

Non-linear polycrystalline fibers are known in the art. One approach for developing such a polycrystalline fiber includes preparing a composite optical fiber preform that can be drawn into an optical fiber using a conventional fiber drawing tower, but which has a central core comprising a polycrystalline or single crystal material. To fabricate this composite perform, a hole is drilled in a fused silica preform and a single crystal or ceramic rod is precision fit into the hole. One crystalline core fiber of great interest includes a crystalline semiconductor core, such as silicon or germanium, useful for Raman applications in the millimeter-wave and infrared wavelengths. This process has created an engineered optical fiber that has significant nonlinear optical applications, but another potential application involves its application as a photoconductive fiber. It has also been proposed in the art to use crystalline semiconductor core fibers as Raman amplifiers.

DETAILED DESCRIPTION OF THE EMBODIMENTS

The following discussion of the embodiments of the disclosure directed to a photoconducting fiber antenna is merely exemplary in nature, and is in no way intended to limit the invention or its applications or uses.

The present disclosure proposes a photoconducting semiconductor fiber antenna developed using semiconductor crystal fiber technologies. The basic operating principal of the semiconductor fiber antenna is that a relatively low power laser diode drives the semi-insulating semiconductor crystal core fiber into a photoconducting state, where the core fiber can function as a conventional RF conductive wire element or an array element.

Figure 1:
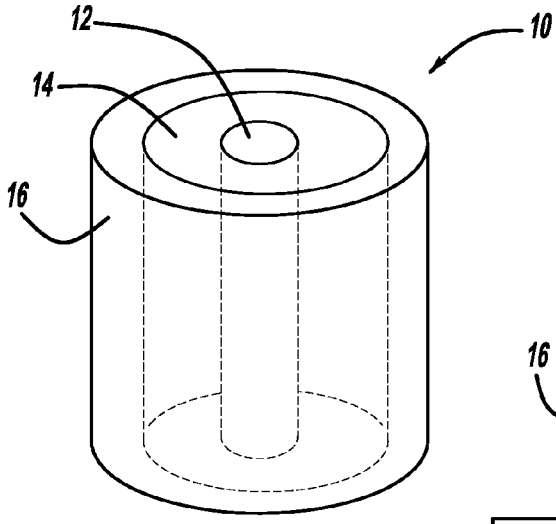
FIG. 1 is a perspective view of a composite preform including a crystalline semiconductor core.
Figure 2:
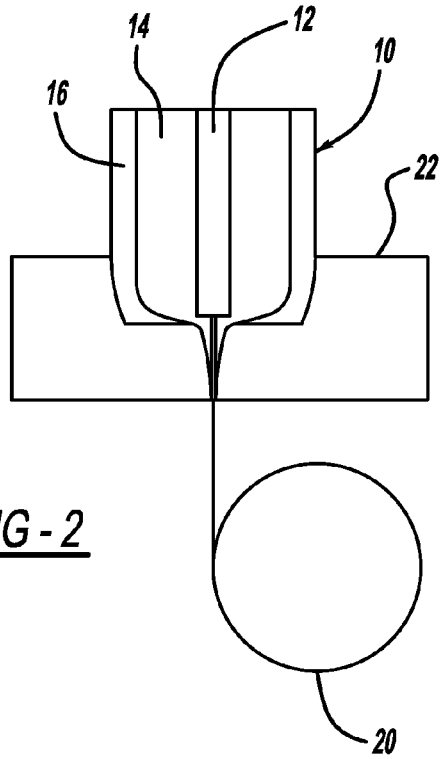
FIG. 2 is a diagram showing a process for drawing the composite preform shown in FIG. 1 into a fiber.

FIG. 1 is a perspective view of a fiber preform 10 that includes a crystalline semiconductor core 12, a glass cladding layer 14 surrounding the core 12 and a polymer jacket 16 surrounding the cladding layer 14 that provides strength and environmental stability. FIG. 2 shows the preform 10 being drawn into a fiber 20 using a hot device 22. The glass cladding layer 14, which may be fused silica, is substantially transparent to laser radiation having photon energy greater than the band gap of the semiconductor crystal material, where the laser radiation will be strongly absorbed by the crystalline semiconductor core 12. Pump light can be guided and defined in the cladding layer 14 by the jacket 16, or air, both of which have a lower index of refraction than the cladding layer 14. The core 12 has a higher refractive index than the cladding layer 14 so that light propagating in the cladding layer 14 is captured or absorbed in the core 12. A semiconductor material having carriers with a long lifetime and a high carrier mobility is generally desired. Suitable examples include germanium and silicon semiconductor materials.

The effective absorption coefficient $\alpha_{eff}$ for the laser light propagating down the cladding layer 14 is given by:

$$\alpha_{eff} = \alpha_o\left(\frac{r_c}{r_{cl}}\right)^2 \tag{1}$$

Where $\alpha_o$ is the absorbtion coefficient of the semiconductor material in the core 12 at the laser wavelength, $r_c$ is the core radius and $r_{cl}$ is the cladding radius.

The laser light absorbed in the core 12 produces photo-carriers with a number density $n_c$ given by:

$$n_c = \frac{\alpha_o \tau}{h\nu} \frac{P_l}{\pi(r_{cl}^2 - r_c^2)} \quad (2)$$

Where $P_l$ is the laser power, τ is the carrier lifetime, h is Plank's constant and v is the laser frequency.

The conductivity of the semiconductor is then generally given by the product of the density of carriers $n_e$, their charge e and their mobility μ as:

$$\sigma_{pc} = \mu e n_c \quad (3)$$

It is seen that the conductivity is proportional to the laser power density in the cladding layer 14 of the semiconductor core fiber.

Figure 3:
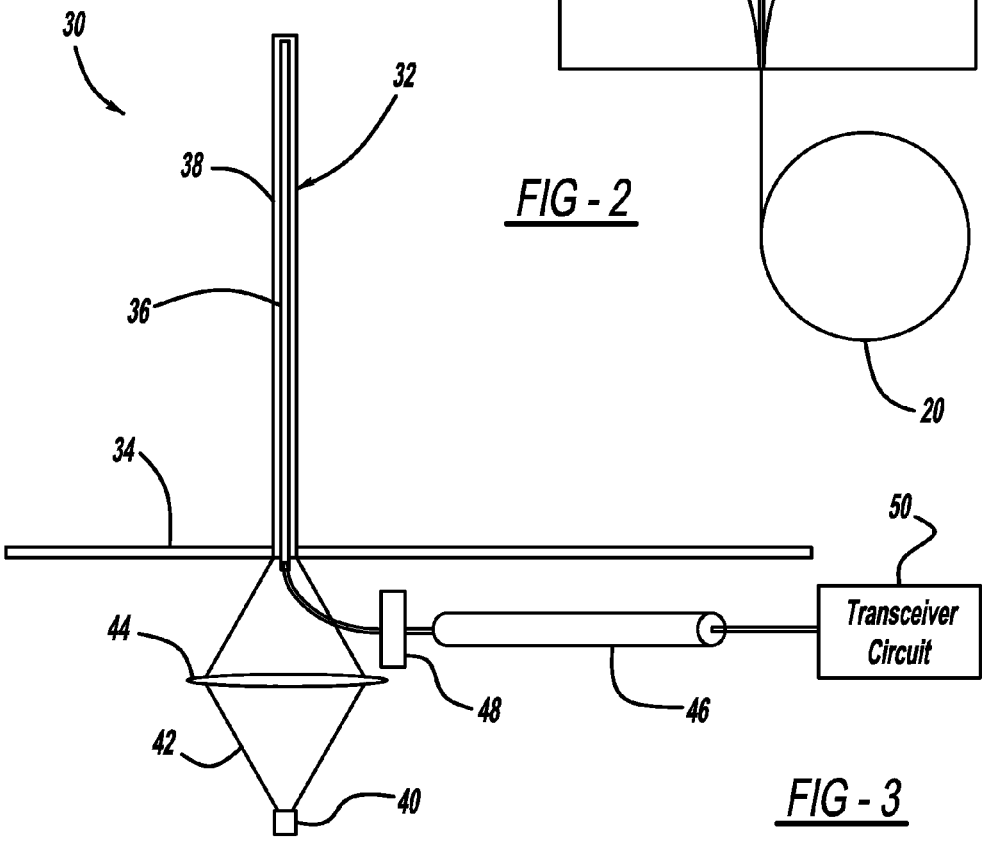
FIG. 3 is an illustration of a photoconducting monopole semiconductor fiber antenna.

There are multiple ways in which the present disclosure can be implemented and applied for useful purposes as an antenna. FIG. 3 shows a transceiver system 30 including a photoconductive semiconductor fiber antenna 32 provided as a resonant monopole antenna on a conducting ground plane 34 or a ground plane comprising a radar absorbing material (RAM). The fiber antenna 32 includes a semiconductor core 36 surrounded by a cladding layer 38, which can be of the type discussed above. The diameter of the semiconductor core 36 and the glass cladding layer 38 can be any diameter suitable for the purposes described herein as a semiconductor fiber antenna. The diameter of the cladding layer 14 may be on the order of 100-500 μm and the diameter of the core 12 may be on the order of 50-100 μm. The semiconductor antenna being discussed herein will have flexibility that allows it to be formed to various structures in which the antenna is being used.

The system 30 includes a laser diode 40 that provides an optical pump beam 42 and optics 44 that focus the pump beam 42 into the cladding layer 38. It would typically be desirable to provide enough pump light to reduce the resistance in the core 36 to be comparable to the radiation resistance of the antenna. In other words, the intensity of the pump light can be selectively controlled to control the efficiency of the antenna. The pump light that is absorbed in the core 36 generates photo-carries, typically electrons, in the semiconductor material that makes the core 36 conductive, and as such a radiating element. The wavelength of the pump beam 42 can be selected to be commensurate with the band-gap energy of the semiconductor material in the core 36 for efficiency purposes. The photo-carries can then be responsive to RF signals in the receive mode for signal reception purposes and transmit signals in the transmit mode for transmission purposes.

An RF signal to be transmitted is provided to the core 36 on line 46 from a transceiver circuit 50 through an RF matching network 48. Likewise, an RF signal that is received by the antenna 32 is sent to the transceiver circuit 50 through the RF matching network 48 on the line 46. The pump beam 42 is focused into the fiber cladding layer 38 by the optics 44, where it propagates down the length of the cladding layer 38 and is absorbed to produce photo-carriers in the semiconductor core 36, as described above. An RF signal to be transmitted is coupled into the semiconductor core 36 by the RF matching network 48 having a suitable design depending on the frequency, antenna length and precise details of the ground plane 34. Design and operation of RF matching networks is well understood to those skilled in the art. The photoconducting semiconductor core 36 functions during laser diode pumping as a conventional Tx/Rx monopole antenna. Monopole antennas are simple antennas that find usage on vehicles, aircraft and fixed installations for which omni-directional coverage is coverable.

Applications for photoconducting semiconductor core fibers are not restricted to simple monopoles. The photoconducting semiconductor fiber itself can be used as either an actively driven radiating element or a parasitic element in an array. The photoconducting semiconductor fiber can be used to construct a dynamic ground plane on a vehicle surface treated with radar absorbing material by simply embedding an appropriate grid or network of controlled photoconductive elements in the surface. An array of such fibers on an LO platform could in principal simulate a primary RCS signature for a variety of aircraft, even simulating engine fans of vibration signatures through appropriate modulating of a laser diode pumping intensity.

Figure 4:
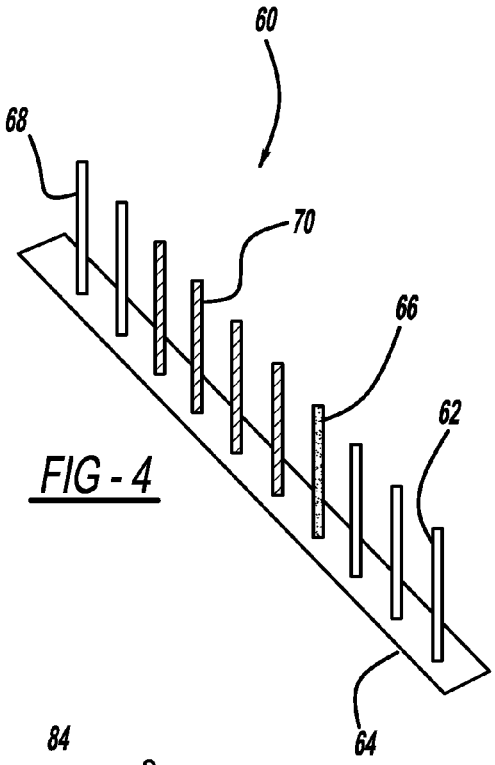
FIG. 4 is an illustration of a multi-element photoconducting fiber antenna having non-excited elements.

Since the photoconducting antenna pattern is impacted by the nature of the ground plane 34 and the presence of parasitic elements, the photoconducting fiber antenna 32 discussed herein can be used to dynamically reconfigure or scan the radiated or receive antenna pattern. FIG. 4 is a perspective view of a multi-element photoconducting fiber antenna 60 including a plurality of semiconductor fiber elements 62 coupled to a common structure 64, where each of the fiber elements 62 includes a core and a cladding layer as discussed above. Some of the fiber elements 62 include fiber elements that are optically pumped, identified by reference number 70, where most of the optically pumped fiber elements 70 operate as parasitic elements and one of the optically pumped fiber elements, identified at reference number 66, is driven by an RF signal. The remaining fiber elements 68 operate as non-excited elements. By providing a certain arrangement of optically pumped parasitic elements and optically pumped and driven element, the far-field radiation pattern of the antenna 60 can be selectively controlled. The antenna 60 shows that multiple elements can be photo-pumped in a single array to control the gain or front-to-back ratio of the antenna.

Figure 5:
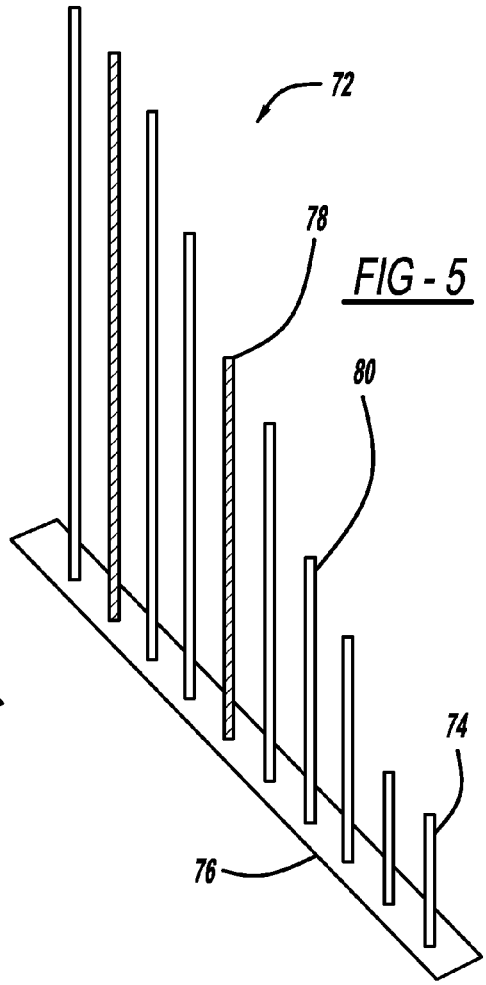
FIG. 5 is a perspective view of a photoconducting fiber antenna including optically pumped elements.

FIG. 5 shows a multi-band photoconducting fiber antenna 72 having a plurality of fiber elements 74 including a core and a cladding layer, as discussed above, where each of the elements 74 has a different length. The multi-band photoconducting fiber antenna 72 including optically pumped fiber elements and non-excited fiber elements show several monopole elements of differing lengths to accommodate operations in different frequency bands. Particularly, some of the elements 74 are optically pumped fiber elements 78 and some of the elements 74 are non-excited fiber elements 80. In this manner, the antenna 72 operates as a log-periodic type antenna, well understood to those skilled in art.

The basic concept of a dynamic reconfigurable antenna enabled by the present disclosure include large structures that can potentially scan beams for commercial applications, such as space communications or cell phone tracking. Consider, for example, a smart cell phone tower that can dynamically steer an antenna beam to different users in synchronism with a code division multiple access (CDMA) code to permit a denser user population.

Figure 6:
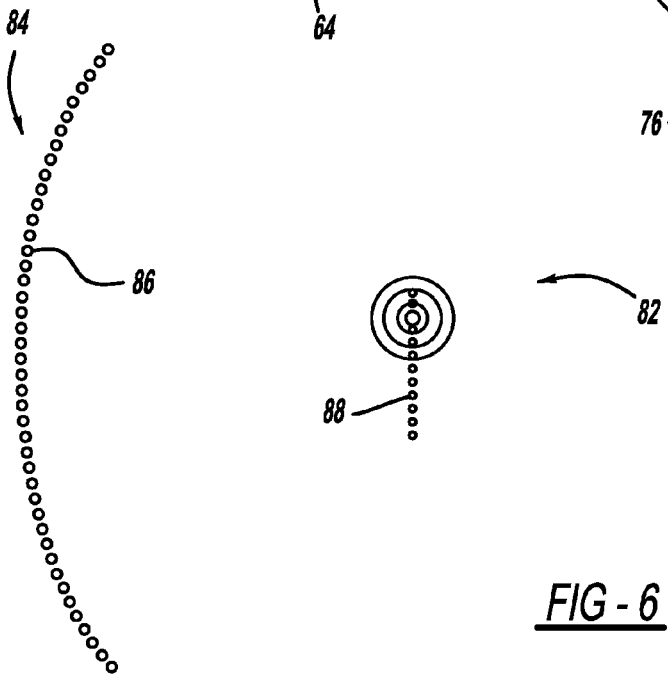
FIG. 6 is an illustration of a dynamically reconfigurable fiber antenna.

FIG. 6 is a plan view of a conceptual antenna array 82 including an array 84 of photoconducting parasitic fiber elements 86 and a collection of fiber emitter elements 88, where the use of any particular emitter results in a beam directed to a different angular position in the far-field. The optically pumped parasitic fiber elements 86 operate as reflectors in that any one of the emitter fiber elements 88 can be driven by an RF signal to control the reflection of the antenna beam by the elements 86 in the desired direction. By switching which of the fiber elements 88 is the driven element, the antenna beam will be directed in a different direction. Further, by selectively choosing a number of the fiber elements 88 to be RF driven, the far-field pattern of the antenna beam can be selectively shaped. It is clear that a high degree of flexibility and dynamic reconfigurability is feasible with photoconducting semiconductor core antenna elements.

The foregoing discussion discloses and describes merely exemplary embodiments. One skilled in the art will readily recognize from such discussion, and from the accompanying drawings and claims, that various changes, modifications and variations can be made therein without departing from the spirit and scope of the invention as defined in the following claims.

What is claimed is:

1. An antenna system comprising:

at least one optical fiber antenna element including a semiconductor core and a cladding layer, said core having a higher index of refraction than the cladding layer;

a pump source providing pump light to the cladding layer in a manner that allows the pump light to propagate down the cladding layer to be absorbed by the core to generate photo-carriers in the core; and an antenna circuit electrically coupled to the core and providing one or both of an RF signal to the core for transmission purposes or receiving an RF signal from the core for reception purposes.

2. The antenna system according to claim 1 wherein the semiconductor core is silicon.

3. The antenna system according to claim 1 wherein the semiconductor core is germanium.

4. The antenna system according to claim 1 wherein the cladding layer is silica.

5. The antenna system according to claim 1 wherein the pump source is a laser diode.

6. The antenna system according to claim 1 wherein the at least one fiber antenna element is a single fiber antenna element and the antenna system is a monopole antenna system.

7. The antenna system according to claim 6 further comprising a ground plane coupled to the fiber antenna element.

8. The antenna system according to claim 1 wherein the at least one fiber antenna element is a plurality of fiber antenna elements configured in an array where one of the fiber antenna elements is optically pumped by pump light and receives a drive signal, a plurality of the other fiber elements are optically pumped but do not receive a drive signal and some of the fiber antenna elements are non-excited fiber elements.

9. The antenna system according to claim 8 wherein all of the fiber antenna elements are the same length.

10. The antenna system according to claim 8 wherein the fiber antenna elements are different lengths.

11. The antenna system according to claim 1 wherein the at least one fiber antenna element is a plurality of fiber antenna elements including a curved array of optically pumped fiber elements operating as a reflector and an array of optically pumped and RF driven fiber elements where the driven fiber elements are selectively driven to control the reflection pattern off of the reflector array of fiber elements.

12. An antenna system comprising a plurality of optical fiber antenna elements each including a semiconductor core and a cladding layer, said core having a higher index of refraction than the cladding layer, wherein some of the fiber antenna elements are parasitic elements, some of the fiber antenna elements are optically pumped fiber elements that generate photo-carriers in the core and one of the fiber antenna elements is an optically pumped element that also receives an RE signal.

13. The antenna system according to claim 12 wherein all of the fiber antenna elements are the same length.

14. The antenna system according to claim 12 wherein all of the fiber antenna elements are different lengths.

15. The antenna system according to claim 12 wherein an array of the optically pumped fiber elements are formed as a curved array and the driven optical fiber element and the parasitic fiber elements are formed in a straight array to control an antenna pattern.

16. The antenna system according to claim 12 wherein the semiconductor core is silicon.

17. The antenna system according to claim 12 wherein the semiconductor core is germanium.

18. An antenna comprising:

at least one optical fiber antenna element including a semiconductor core and a cladding layer, said core having a higher index of refraction in the cladding layer; and a pump source providing pump light to the cladding layer in a manner that allows the pump light to propagate down the cladding layer to be absorbed by the core to generate photo-carries in the core where the photo-carriers operate as a conductor to receive or transmit RF signals.

19. The antenna according to claim 18 wherein the semiconductor core is silicon or germanium.

20. The antenna according to claim 18 wherein the at least one fiber antenna element is a plurality of fiber antenna elements including some optically pumped fiber elements, some parasitic fiber elements and at least one optically pumped and RF driven fiber element.

* * * * *